US005078350A

United States Patent [19]

Zorichak

[11] Patent Number: 5,078,350

[45] Date of Patent: Jan. 7, 1992

[54] ADJUSTABLE INCLINED SURFACE CONTAINER HOLDER

[76] Inventor: Christopher Zorichak, 1945 Norwood Ave., Boulder, Colo. 80304

[21] Appl. No.: 491,324

[22] Filed: Mar. 9, 1990

[51] Int. Cl.[5] ..... A47G 23/02

[52] U.S. Cl. ..... 248/148

[58] Field of Search ..... 248/148, 149, 151, 154, 248/432, 398, 688; 24/306, 442

[56] References Cited

U.S. PATENT DOCUMENTS

| | | | |
|---|---|---|---|
| 753,942 | 3/1904 | Wallace | 248/148 |
| 825,248 | 7/1906 | Silver | 248/148 |
| 948,255 | 2/1910 | Schwartz | 248/151 |
| 1,021,903 | 4/1912 | Stahr | 248/148 |
| 1,193,307 | 8/1916 | Sorley . | |
| 1,313,446 | 8/1919 | Wright | 248/151 |
| 1,423,726 | 7/1922 | Mohr . | |
| 1,548,681 | 8/1925 | Grimes | 248/148 |
| 2,140,045 | 12/1938 | Bergstrom | 248/148 |
| 2,561,845 | 7/1951 | Curry | 248/148 |
| 2,750,139 | 6/1956 | Young | 248/148 |
| 2,837,305 | 6/1958 | Andrew | 248/148 |
| 2,853,261 | 9/1958 | Loeb | 248/151 |
| 3,262,665 | 7/1966 | Black | 248/688 |
| 4,273,130 | 6/1981 | Simpson | 24/442 |
| 4,842,229 | 6/1989 | Murray | 248/148 |
| 4,878,274 | 11/1989 | Patricy | 24/306 |

*Primary Examiner*—Renee S. Luebke
*Assistant Examiner*—Michael J. Milano

[57] ABSTRACT

An adjustable holder for supporting a container (30) on an inclined surface (40), the holder having a container band (10) with support leg apertures (20), a velcro-type loop (12) and hook (14) fastener, having the loop and hook portions (12 and 14) thereof secured to a fabric (16) and to the container band (10). An attached rectangular threading loop (18) where the fastener-holding fabric (16) is inserted to secure and fasten the container band (10) to a container (30). Two support legs (22), each with a taper terminus (24) located at the bottom end thereof, and an angle (26) in each support leg located where the support leg (22) protrudes from the container band (10), are weaved through the support leg apertures (20) thus securing the legs in place on the band.

15 Claims, 2 Drawing Sheets

ADJUSTABLE INCLINED SURFACE CONTAINER HOLDER

FIELD OF INVENTION

This invention relates to a device for stabilzing and supporting a cylindrical or non-cylindrical container on various inclined surfaces.

DESCRIPTION OF PRIOR ART

Heretofore, there has not been an adjustable inclined surface container holder comprising a high friction pliant band which can attach directly to and conform to a cylindrical as well as to a non-cylindrical container, or which is adjustable to accomidate different inclined surfaces merely by changing the holding band's location on the container.

U.S. Pat. No. 4,842,229 to Murray discloses a platform that is separate and not secured to the container to be supported, making it necessary to use both hands to relocate and reposition the platform and container on an inclined surface and to adjust the rod members (supporting legs) for varying inclined surfaces while keeping the container upright. From the point of safety, it is imperative to have one free hand at all times while operating on a sloped surface, thus greatly reducing the risk of injury and spillage of a container's contents.

U.S. Pat. No. 2,837,305 to Andren shows two separate attachable supports that have to be placed on a container individually. This task of attaching the supports one at a time is not only time consuming, but the supports must also be placed on the container accurately to assure its stability. If the supports are placed too close together or too far apart, the container will not be safely stabilized on an inclined surface. In addition, its lower bracket member has upward protrusions, making the supports usable only on containers with a bottom lip, which standard plastic containers do not have. U.S. Pat. No. 1,021,903 to Stahr shows a like construction with similar awkwardness and limited usage on today's market.

U.S. Pat. No. 2,750,139 to Young discloses a platform container holder with clamping screws to secure a container in place. This container holder will work adequately with a standard one gallon paint can, but not has limited other uses. In using the three clamping screws located at the base of the platform, a container being secured must have a beaded bottom edge to assure the container remains affixed to the platform. Such a system will not work on the majority of today's containers, since many are made of plastic and coated paper, many are tapered, and many do not have a beaded bottom edge.

U.S. Pat. No. 2,140,045 to Bergstrom shows a container support system that must have a container with a bottom lip to which the container support must be attached. This makes its application very limited in today's market. The support legs are also non-adjustable, making it inadequate for different inclined surfaces.

U.S. Pat. No. 1,423,726 to Mohr shows a platform with support legs and a contractible band which secure to a container. The band appears to be unable to conform to tapered or beveled containers. The supporting legs are able to be positioned flush with the platform, but they are not adjustable vertically from the platform, making the container holder unadaptable to different inclined surfaces.

U.S. Pat. No. 1,193,307 to Sorley discloses a complicated apparatus with a spring locking bottom plate, whereby is necessary to have a container with a surface-engaging beaded edge. It is of expensive construction and awkward operation. This apparatus will not conform to non-cylindrical, plastic, or containers that are larger than a one gallon size.

U.S. Pat. No. 825,248 to Silver shows a container support comprising a band having three adjustable legs. Besides the difficulty involved in adjusting three independent legs to adapt to an inclined surface, the container support does not attach to a container, making it inferior in its ability to move both the container and the container support.

U.S. Pat. No. 753,942 to Wallace discloses a two band system with non-removable vertical support legs. The securing means of the holder to a container is by a two band clamping system, whereby the bands are independent and secured to one another. The support legs are non-removable from the main securing band, making it necessary to detach the entire holding device to set a supported container on a horizontal surface. Its primary function is for holding paint-buckets, making its use quite limited.

OBJECTS AND ADVANTAGES OF THE INVENTION

Accordingly, several objects and advantages of this invention are:

(a) to provide an inclined surface container holder which can quickly and easily be attached to and detached from a container;

(b) to provide an inclined surface container holder whose elastic and pliant properties can conform to many different size and shape containers, including non-cylindrical, tapered, beveled, etc.;

(c) to provide an inclined surface container holder which will attach securely to most container materials, whether they be paper, plastic, or metal;

(d) to provide an inclined surface container holder which when attached to a container forms a single mobile unit, allowing easy movement and relocation of the container and the attached holder;

(e) to provide an inclined surface container holder which is adjustable to most inclined surfaces without completely removing it from a container, the holder including a container band which can be adjusted simply by sliding the container band up or down the container;

(f) to provide an inclined surface container holder that will free up one's hands while climbing to and from a roof or other inclined surface, as well as while on the roof, thus greatly increasing safety;

(g) to provide an inclined surface container holder that can be easily broken down to form a compact assembly, and can then be stored in any size tool box or storage facility;

(h) to provide an inclined surface container holder with removable support legs so that a container can easily be set on a horizontal surface without disconnecting the holder from the container.

BRIEF DESCRIPTION OF THE DRAWINGS

In the drawings, similar reference numerals are used on occasion in the different drawing views to show a relative component from various angles.

REFERENCE NUMERALS IN DRAWINGS

Figure 1:
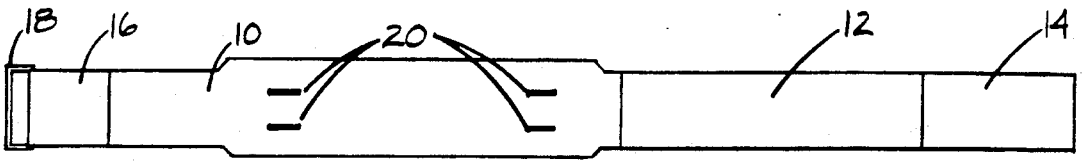
FIG. 1 shows the container band of the invention in its flat state from a front or outside view.

| | |
|---|---|
| 10 container band | 24 support leg taper terminus |
| 12 loop portion of fastener | 26 support leg angle or bend |
| 14 hook portion of fastener | 30 container |
| 16 fabric | 31 container's central axis |
| 18 rectangular threading loop | 40 roof |
| 20 support leg aperture | 41 upslope roof portion |
| 22 support leg | 42 downslope roof portion |

DETAILED DESCRIPTION OF THE INVENTION

The preferred materials of the inclined surface container holder of the invention comprise of, but are not limited to the following:

- a container band 10 comprising of a closed-cell, relatively high friction neoprene rubber;
- a band fastener comprising of a loop portion 12 and hook portion 14 of VELCRO, available from Velcro U.S.A., Inc. of Westlake Village, Calif.
- a fabric 16 comprising of canvas or nylon;
- a rectangular threading loop 18 comprising of metal;
- an angled or bent support leg 20 comprising of aluminum.

Figure 2:
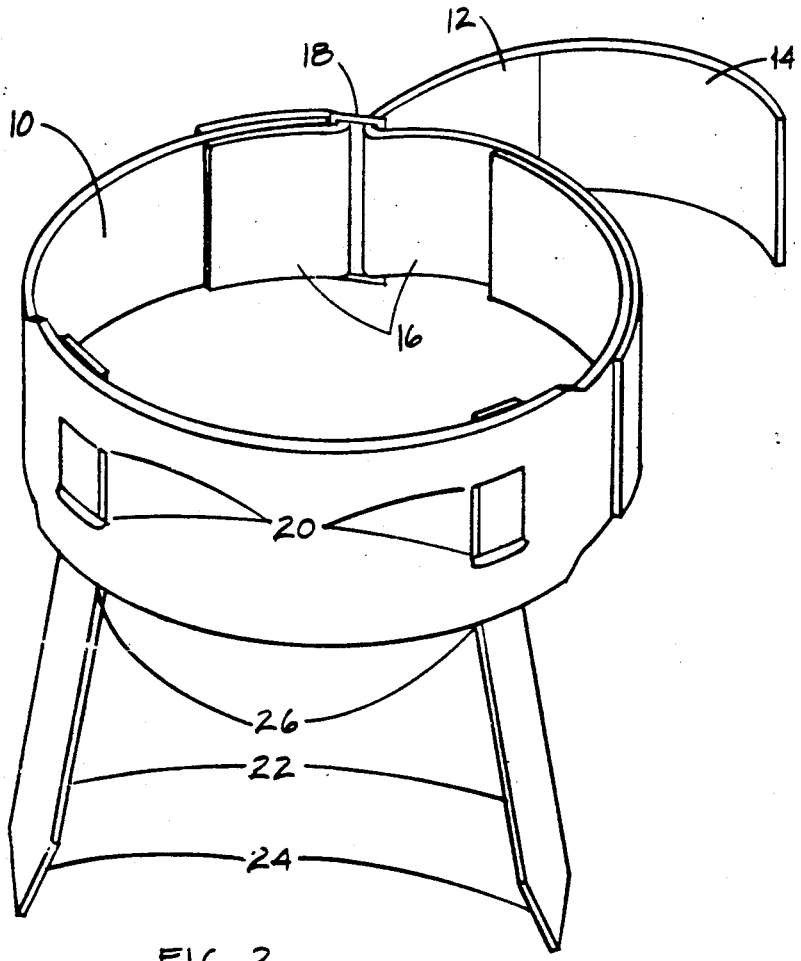
FIG. 2 is a perspective view showing the container band with its velcro-type attaching means threaded through a rectangular threading loop, and with support legs inserted into support leg apertures or slots that are carried by the container band.
Figure 3:
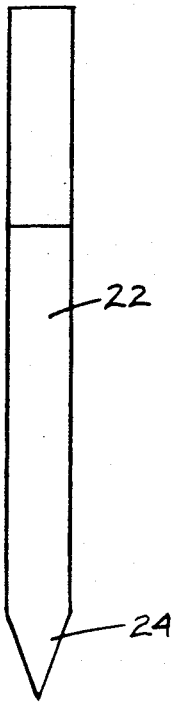
FIG. 3 is a front view of a support leg.
Figure 4:
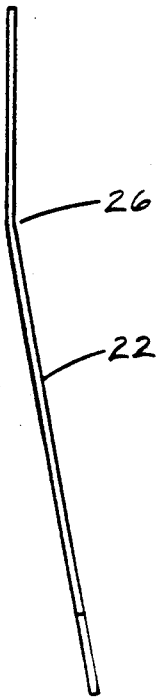
FIG. 4 is a side view of a support leg.
Figure 5:
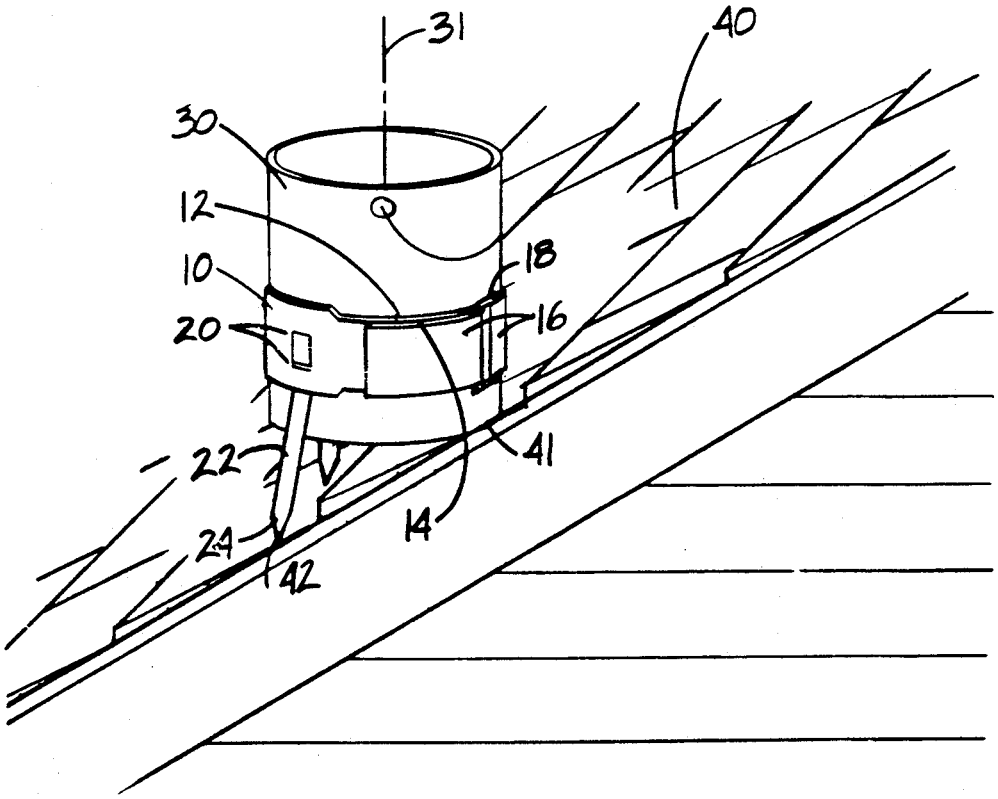
FIG. 5 is a perspective view of the invention in a state of operation relative to an inclined roof.

A typical illustration of container band 10 is shown in FIG. 1 (front view), FIG. 2 (perspective view), and FIG. 5 (perspective view). Container band 10 is roughly 70 cm (27.5 in.) in length or longer and about 3.2 mm (0.125 in.) thick. Container band 10 has a tapered size reduction from approximately 63.5 mm (2.5 in.) wide to 50.8 mm (2.0 in.), located roughly 11.4 cm (4.5 in.) in from the left band end and 33 cm (13.0 in.) in from the right band end. The 63.5 mm wide section is about 25.4 cm (10.0 in.) long and provides added support for legs 22.

Support legs 22 are secured to container band 10 by any suitable elastic fastening means. Preferably, the container band 10 is made of rubber and four support leg apertures 20 are formed therein for receiving the support legs 22, as shown in FIGS. 1, 2, and 5. Support leg apertures 20 are approximately 19 mm (0.75 in.) long, and are located roughly 85.7 mm (3.375 in.) in each direction from the center of the 25.4 cm/63.5 mm wide section of container band 10.

As shown in FIG. 2, a velcro-type fastener having a loop portion 12 and hook portion 14 are secured to a length of fabric 16 (FIG. 2). Fastener portions 12 and 14 are roughly 50.8 mm (2.0 in.) wide, with a length of 20.3 cm (8.0 in.) and 10.2 cm (4.0 in.) respectively.

As shown in FIGS. 1, 2, and 5, a rigid rectangular metal threading loop 18 is attached to container band 10 by the use of a length of fabric 16. Loop 18 is approximately 50.8 mm (2.0 in.) long, 19 mm (0.75 in.) wide, and 3.2 mm (0.125 in.) thick.

The removable support legs 22 by which a container 30 is supported relative to an inclined roof 40 is shown in FIGS. 2, 3, 4, and 5. Each leg 22 is roughly 20.3 cm (8.0 in.) long, 19 mm (0.75 in.) wide, and 3.2 mm (0.125 in.) thick. Each leg 22 has a taper terminus 24 located at the bottom of the support leg 22 that comes to a point at the end. Also incorporated into each support leg 22 is an angle or bend 26 in the support leg. Angle 26 starts approximately 63.9 mm (2.5 in.) from the top of the support leg 20 and angles a small degree outward at that point. In use, this lower angled portion points away from the central axis 31 of container 30 (see FIGS. 2 and 5).

OPERATION

The manner of using the adjustable inclined surface container holder of the invention is an easy procedure. The simplicity of its assembly and of the fastening system used to attach it to a container are explained in detail in the following paragraphs.

Assembly of this invention consists merely of weaving support legs 22 through support leg apertures 20 located on or in container band 10. As shown in FIGS. 2 and 5, a support leg 22 is first brought up from the bottom on the back or container side of container band 10 (the side to be in contact with container 30). The support leg 22 is then passed through the bottom support leg aperture 20, over the top (back) of container band 10 (the band position is in accordance with FIGS. 1 and 2), and back through the top support leg aperture 20. The support leg 22 is slid upward until support leg angle 26 comes in contact with the bottom edge of band 10, at which time the top end of support leg 22 is flush with the top edge of band 10.

Thus, the container band 10 and apertures 20 provide elastic fastening means for securing the legs 22 to the container band 10.

A taper terminus 24 is incorporated into each support leg 22 to provide additional anchoring support on an inclined surface, such as roof 40.

Once the support legs 22 have been thus mounted or secured, container band 10 is ready to be fastened to container 30. This is done by inserting the end of fabric 16 (with fastener portions 12 and 14 attached) through rectangular threading loop 18, pulling fabric 16 until container band 10 is held firmly to the outside perimeter of container 30, and connecting loop portion 12 and hook portion 14 together by pressing portion 14 onto portion 12 (see FIG. 5). Container band 10 is pliant, thus allowing it to conform to a container's shape and size and to insure a proper fit and support. Preferably band 10 includes a relatively high friction surface adjacent to container 30.

As can best be seen in FIG. 2, support leg apertures 20 within band 10 are located relatively close to each other, such that when band 10 is placed around container 30, as is shown in FIG. 5, the two support legs 22 are both positioned to one side of the container's center of gravity and its central vertical axis 31. As a result of this construction and arrangement, container 30 can now be supported on an inclined surface, such as roof 40 of FIG. 5, with one portion of the container's flat bottom surface engaging an upslope portion 41 of roof 40, and with the taper terminus 24 of each support leg 22 engaging a downstream portion 42 of roof 40.

The inclined surface container holder of the invention, once attached to container 30, is easily adjusted to different inclined surfaces 40 simply by sliding container band 10 vertically up or down relative to the vertical axis of the container. The container can also be set on a horizontal surface by sliding the container band 10 to its upmost position on the container, or by removing the support legs 22. Both of these functions can be accomplished without removing the container band 10 from the container.

As can be seen from the above description, the invention provides an inclined surface container holder for use with a container 30 having side wall means of any of a variety of configurations (round, tapered, etc.), a vertically extending central axis 31 and a generally flat bottom surface that extends generally normal to axis 31. The holder of the invention includes a pliant elongated band 10 having two oppositely disposed ends, and at least two support leg securing means 20 located at relatively closely spaced locations along the length of the band. Fastening means 12, 14, and 18 are affixed to the ends of band 10, to thereby enable the band to be placed in encircling relation to the side wall of container 30, and to be secured to the side walls by operation of the fastening means 12, 14, and 18. When so secured, the plane established by the encircling band then extends generally normal to the container's central axis 31 (see FIG. 5). A support leg 22 is provided to cooperate with each individual one of the leg securing means 20. Each support leg 22 extends downward beyond the bottom surface of container 30, and the bottom of each leg 22 terminates in a terminus end portion 24. In this manner, the encircled container 30 may be supported on inclined surface 40 with one portion of the container's bottom surface engaging an upslope portion 41 of the inclined surface, and with the support leg terminus portions 24 engaging a downstream portion 42 of the inclined surface. While the assembly of band 10 and support legs 22 is relatively flexible prior to being placed on a container, once the band is tightly drawn around the container, the band/leg assembly becomes a rigid assembly.

Those skilled in the art will readily appreciate that the adjustable inclined surface container holder of the invention can be used to support containers of various sizes, shapes, and material composition easily and conveniently. The device of the invention can be attached to and detached from a container proficiently without difficulty, and its assembly and disassembly is simple. The method of adjustment and adaptability to different inclined surfaces is one of simplicity and accuracy.

Among the new, unusual, and unexpected results achieved by the invention are:

it provides a container holder whose pliant properties allow it to conform to many different shaped containers, including tapered, beveled, square, etc.;

it provides a relatively high friction interface to thereby securely fasten to many container materials, including plastic, paper, and metal;

it provides a container holder which forms a single mobile and adjustable unit with the container in use, allowing easy movement and relocation of the container;

it provides a container holder that will free up one's hands while climbing to and from an inclined surface, as well as while on an inclined surface, thus greatly increasing safety;

it provides a container holder that can easily be broken down and stored in any size tool box or storage facility, and can be packaged for sale in a small, compact container;

it provides a container holder with removable support legs so the container can be easily set on a flat surface without removing the entire unit from the container.

Although the above description of preferred embodiments of the invention contains many specificities, these should not be construed as limiting the scope of the invention, but as merely providing illustrations of some of the presently preferred embodiments of this invention. For example, the container band can have other sizes, shapes, and material components, such as a longer band for larger diameter containers (for example, a two, three, or five-gallon container) or a wider or thinner band, an oblong oval shape band, or one made of cloth, light-gauge metal, or other pliant and conforming materials; the support leg apertures of the band can be more in number or can be of a different shape, or consist of a clamp, interlocking, affixed system, etc.; the velcro-type hook and loop fastening system can be one of an adjustable clamp or similar structure, and can be attached to the band by way of rivots, adhesives, vulcanization, etc.; the rectangular threading loop can be of different size, shape or composition; the fabric portion of the band can be of different materials, such as leather, weaved or braided cotton, metal (to secure the rectangular loop), etc.; the support legs can be of different size, shape, and material, such as wider, thinner, longer, shorter, and with different or no angles therein, and may be made of other metals (steel, etc.) plastic composition, etc.

Thus the scope of the invention should be determined by the appended claims and their legal equivalents, rather than by the above description.

What is claimed is:

1. An adjustable inclined surface container holder comprising:

an elongated pliant band having a plurality of elastic fastening means at spaced locations along the length thereof for securing support legs to said band, the band also having cooperating fastening means affixed to end portions thereof to enable said band to be secured in encircling relation to a container with said band's vertical location on the container enabling the container to be adjusted to accommodate relatively large variations in inclined surface angles; and a plurality of elongated support legs having an upper end and a lower end, the upper end of each support leg cooperating with one of said elastic fastening means and the lower end of each support leg extending downward from the band for engagement with an inclined surface.

2. The adjustable inclined surface container holder of claim 1 wherein said band is composed of a high friction material.

3. The adjustable inclined surface container holder of claim 2 wherein said band is composed of rubber.

4. The adjustable inclined surface container holder of claim 3 wherein said fastening means is a threading loop at one end of said band and a loop/hook fastener affixed to the other end of said band.

5. The adjustable inclined surface container holder of claim 4 wherein said loop/hook fastening means is composed of a velcro-type material.

6. The adjustable inclined surface container holder of claim 1 wherein each support leg has a bend at a position below the band when the support leg is secured in place on said band, the portion of the leg below said bend extending at an angle away from the vertical central axis of the container.

7. The adjustable inclined surface container holder of claim 1 wherein the elastic fastening means is composed of rubber.

8. The adjustable inclined surface container holder of claim 1, wherein the support legs are releasably secured to the band by the elastic fastening means.

9. An adjustable inclined surface holder for use with a container having side wall means, a vertically extending central axis and a generally flat bottom surface that extends generally normal to the container's central axis, the holder comprising:

an elongated elastic band having side edges, two end portions, and at least two vertical rows of spaced apart slots including at least an upper slot and a lower slot such that at least one strip portion is formed therebetween to secure a support leg, said rows being spaced apart along the length of said band, and each slot being substantially the same length as the width of an upper end of a support leg and being substantially parallel to the side edges of the band;

cooperating fastening means affixed to said end portions of said band, to thereby enable said band to be placed in encircling relation to the side wall means of a container, and to be secured to the side wall means of a container by operation of said fastening means, the plane established by the encircling band then extending generally normal to the container's central axis; and a plurality of elongated support legs having an upper end and a lower end, the upper end of each support leg cooperating with each slot in one of said rows of slots such that the strip portion releasably secures said support leg, and the lower end of each support leg extending downward from the band beyond the bottom surface of a container to which said band is secured for engagement with an inclined surface.

10. The adjustable inclined surface container holder of claim 9 wherein said band is composed of a pliant high friction material.

11. The adjustable inclined surface container holder of claim 10 wherein said band is composed of rubber.

12. The adjustable inclined surface container holder of claim 11 wherein said fastening means is a threading loop at one end of said band and a loop/hook fastener affixed to the other end of said band.

13. The adjustable inclined surface container holder of claim 12 wherein said loop/hook fastening means is composed of a velcro-type material.

14. The adjustable inclined surface container holder of claim 9 wherein each support leg has a bend at a position below the band when the support leg is secured in place on said band, the portion of the leg below said bend extending at an angle away from the vertical central axis of the container.

15. The adjustable inclined surface container holder of claim 9, wherein each row of slots comprises one upper slot and one lower slot which form a single strip portion.

* * * * *

UNITED STATES PATENT AND TRADEMARK OFFICE

CERTIFICATE OF CORRECTION

PATENT NO. : 5,078,350

DATED : January 7, 1992

INVENTOR(S) : Christopher Zorichak

It is certified that error appears in the above-identified patent and that said Letters Patent is hereby corrected as shown below:

TITLE PAGE:

IN THE REFERENCES CITED ITEM [56]

On page 1, column 1, please delete "1,423,726" and substitute therefor --1,423,720--.

In column 1, line 6, please delete "stabilzing" and substitute therefor --stabilizing--.

In column 1, line 15, please delete "accomidate" and substitute therefor --accommodate--.

Signed and Sealed this

Sixth Day of July, 1993

*Attest:*

Michael K. Kirk

MICHAEL K. KIRK

*Attesting Officer*

*Acting Commissioner of Patents and Trademarks*